US010290458B2

(12) United States Patent
Schlaak et al.

(10) Patent No.: US 10,290,458 B2
(45) Date of Patent: May 14, 2019

(54) FUSE AND METHOD OF FORMING A FUSE

(71) Applicant: Littelfuse, Inc., Chicago, IL (US)

(72) Inventors: Michael Schlaak, Morton Grove, IL (US); Ganesh Chennakesavelu, Lombard, IL (US); William Gonzalez, Tolono, IL (US)

(73) Assignee: Littelfuse, Inc., Chicago, IL (US)

( * ) Notice: Subject to any disclaimer, the term of this patent is extended or adjusted under 35 U.S.C. 154(b) by 14 days.

(21) Appl. No.: 15/245,999

(22) Filed: Aug. 24, 2016

(65) Prior Publication Data

US 2018/0061607 A1 Mar. 1, 2018

(51) Int. Cl.

| | |
|---|---|
| ***H01H 85/38*** | (2006.01) |
| ***H01H 69/02*** | (2006.01) |
| ***H01H 85/045*** | (2006.01) |
| ***H01H 85/175*** | (2006.01) |
| ***H01H 85/157*** | (2006.01) |
| *H01H 85/47* | (2006.01) |

(52) U.S. Cl.

CPC ..... *H01H 85/38* (2013.01); *H01H 69/02* (2013.01); *H01H 85/045* (2013.01); *H01H 85/157* (2013.01); *H01H 85/175* (2013.01); *H01H 85/0458* (2013.01); *H01H 85/47* (2013.01); *H01H 2085/388* (2013.01)

(58) Field of Classification Search

CPC ..... H01H 69/02; H01H 85/38; H01H 85/045; H01H 85/0458; H01H 85/143; H01H 85/157; H01H 85/0418; H01H 2085/381; H01H 2085/383; H01H 2085/388; H01H 85/47; H01H 85/175

USPC ..... 337/231, 232, 248, 252, 273

See application file for complete search history.

(56) References Cited

U.S. PATENT DOCUMENTS

| | | | | |
|---|---|---|---|---|
| 961,891 A * | 6/1910 | Orelli | H01H 85/157 | 337/234 |
| 1,387,000 A * | 8/1921 | Fisher | H01H 85/157 | 337/252 |
| 1,443,886 A * | 1/1923 | Sands | H01H 85/143 | 337/234 |
| 1,447,798 A * | 3/1923 | McDonald | H01H 85/157 | 337/237 |
| 3,529,270 A * | 9/1970 | Kozacka | H01H 85/0458 | 337/232 |

(Continued)

FOREIGN PATENT DOCUMENTS

GB 611684 A * 11/1948 ..... H01H 85/157

OTHER PUBLICATIONS

ISR and Written Opinion dated Oct. 19, 2017, in corresponding PCT/US2017/047290.

*Primary Examiner* — Jacob R Crum

(57) ABSTRACT

Embodiments of the fuse include a fuse body having a first end and a second end. A fuse element is disposed within a cavity of the fuse body, an end of the fuse element extending beyond an edge of the fuse body. An arc disc is disposed on the edge of the fuse body, and includes a notch such that the end of the fuse element extends to an outer surface of the arc disc. The end of the fuse element is configured to be folded over the outer surface of the arc disc. An end cap is disposed over the end of the fuse body and the arc disc, and the end cap includes a hole at a top surface. Solder deposited within the hole provides an electrical connection between the arc disc, the fuse element, and the end cap.

18 Claims, 7 Drawing Sheets

(56) References Cited

U.S. PATENT DOCUMENTS

| | | | | |
|---|---|---|---|---|
| 4,656,453 | A * | 4/1987 | Reeder | H01H 69/02 337/236 |
| 2002/0101323 | A1 | 8/2002 | Ranjan et al. | |
| 2010/0245025 | A1 * | 9/2010 | de Leon | H01H 85/0418 337/290 |
| 2012/0032772 | A1 | 2/2012 | Smith et al. | |
| 2016/0141138 | A1 | 5/2016 | Schlaak et al. | |

* cited by examiner

FUSE AND METHOD OF FORMING A FUSE

FIELD OF THE DISCLOSURE

Embodiments of the present disclosure relate generally to the field of fuses, and more particularly to a fuse and method of forming a fuse.

BACKGROUND OF THE DISCLOSURE

Fuses are used as circuit protection devices and form an electrical connection with a component in a circuit to be protected. One type of fuse includes a fusible element disposed within a hollow fuse body. Upon the occurrence of a specified fault condition, such as an overcurrent condition, the fusible element melts or otherwise opens to interrupt the circuit path and isolate the protected electrical components or circuit from potential damage. Such fuses may be characterized by the amount of time required to respond to an overcurrent condition. In particular, fuses that comprise different fusible elements can accommodate varying amounts of current through the fusible element. Thus, by varying the size and type of fusible element, different operating times may be achieved.

When an overcurrent condition occurs, an arc may be formed between the melted portions of the fusible element. If not extinguished, this arc may further damage the circuit to be protected by allowing unwanted current to flow to circuit components. Thus, it is desirable to manufacture fuses which extinguish this arc as quickly as possible. In addition, as fuses decrease in size to accommodate ever smaller electrical circuits, there is a need to reduce manufacturing costs of these fuses.

Existing fuses include a blind assembly of the electrical connection between the fusible element and an end cap. A solder plug is disposed on an underside of an end cap, and the fuse is heated so the solder reflows. Ideally, the solder reflows and electrically connects the fusible element with the end cap, so that each end of the fuse is electrically connected. However, it can be difficult or costly to thoroughly inspect the solder connection without destructive testing. Undetected defects in the solder connection may result in decreased performance or reliability of the finished fuse.

SUMMARY

A need therefore exists for a fuse that can be easily inspected during the manufacturing process to ensure high quality control.

An embodiment of the present invention includes a fuse comprising a fuse body having a first end and a second end, and defining a cavity. A fuse element is disposed within the cavity, a first end of the fuse element extending beyond a first edge of the first end of the fuse body. A first arc disc is disposed on the first edge of the fuse body, the first arc disc including a notch cut providing a pass-through area for the first end of the fuse element extending beyond the first edge of the first end of the fuse body. The first end of the fuse element is configured to be folded over an outer surface of the first arc disc. A first end cap is disposed over the first end of the fuse body and the first arc disc, the first end cap having a hole at a top surface and positioned to expose the first arc disc and the first end of the fuse element, such that solder deposited within the hole provides an electrical connection between the first arc disc, the fuse element, and the first end cap.

An embodiment of the present invention includes a fuse comprising a hollow fuse tube and a fuse element disposed within the hollow fuse tube, ends of the fuse element extending beyond edges of ends of the hollow fuse tube. Plugs are disposed within the ends of the hollow fuse tube, wherein the plugs secure the fuse element at each end within the hollow fuse tube. Arc discs are disposed on the edges of the hollow fuse tube and covering the plugs, the arc discs having a notch cut providing a pass-through area for the ends of the fuse element extending beyond the edges of the hollow fuse tube, wherein the ends of the fuse element are configured to be folded across an outer surface of the respective arc disc. End caps cover the respective ends of the hollow fuse tube, plugs, arc discs, and folded ends of the fuse element, and the end caps have a hole in a top surface such that the arc disc and folded end of the fuse element are exposed. Solder is deposited within the hole of the end caps such that the respective end caps, arc discs, and folded end of the fuse element are electrically connected.

An embodiment of the present invention includes method for forming a fuse comprising inserting a fuse element in a cavity of a fuse body, ends of the fuse element extending beyond edges of the respective ends of the fuse body. Arc discs are assembled on the edges of the fuse body, the arc discs having a notch cut providing a pass-through area for the ends of the fuse element extending beyond the edges of the fuse body. The ends of the fuse element are formed over an outer surface of an arc disc. End caps are attached over the ends of the fuse body, the end caps having a hole at a top surface of the end cap, the hole being positioned to expose the arc disc and the formed end of the fuse element when attached. Solder is deposited in the hole of the end cap, such that the end cap, the arc disc, and the formed end of the fuse element at each end of the fuse body are electrically connected.

BRIEF DESCRIPTION OF THE DRAWINGS

By way of example, specific embodiments of the disclosed device will now be described, with reference to the accompanying drawings, in which.

DETAILED DESCRIPTION

Figure 1:
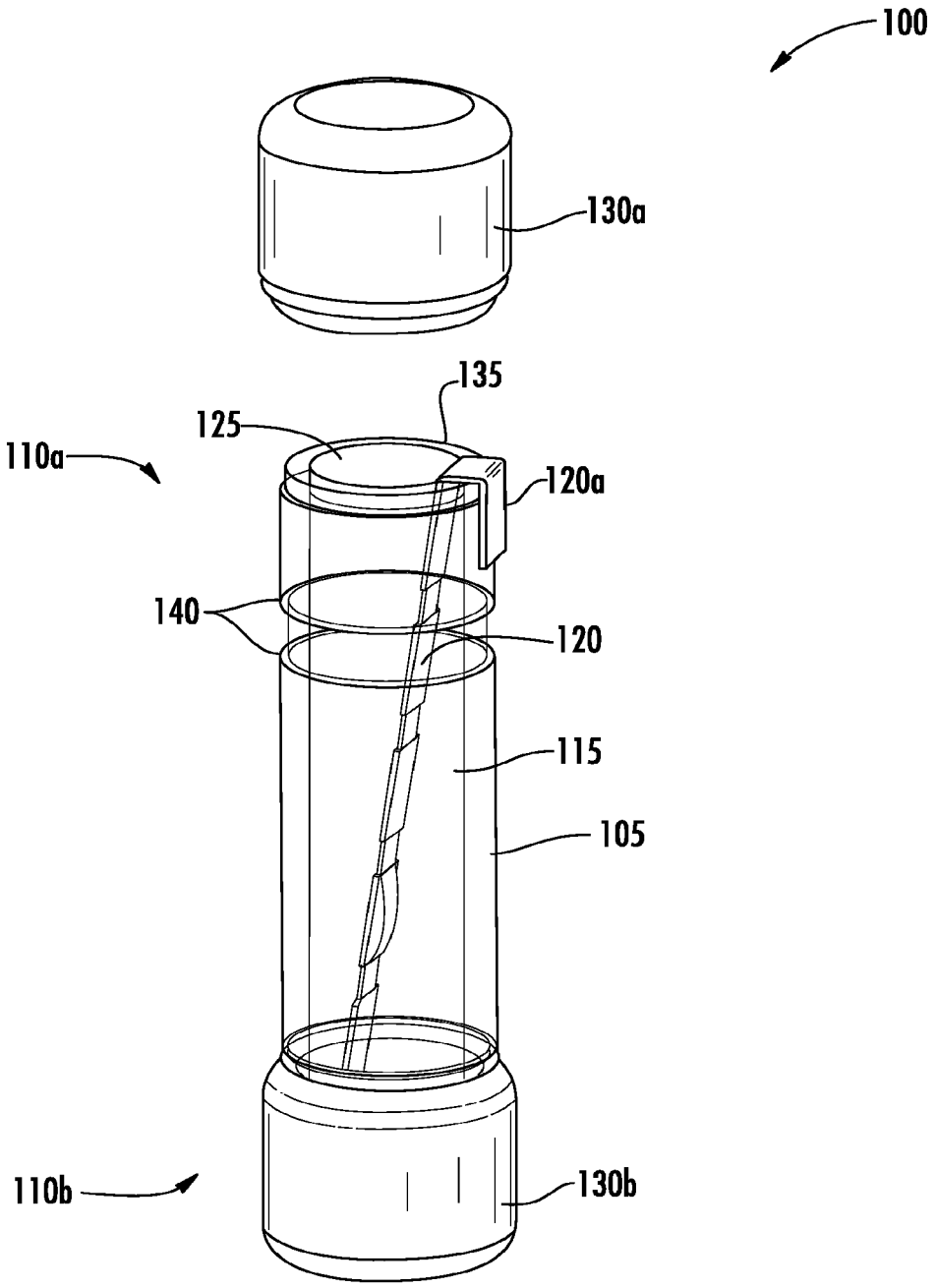
FIG. 1 Prior Art
FIG. 1 illustrates a partial exploded view of an existing fuse.

A fuse assembly in accordance with the present disclosure will now be described more fully hereinafter with reference to the accompanying drawings, in which certain exemplary embodiments of the fuse are presented. The fuse may be embodied in many different forms and is not to be construed as being limited to the embodiments set forth herein. These embodiments are provided so that this disclosure will be thorough and complete, and will fully convey the scope of the fuse to those skilled in the art. In the drawings, like numbers refer to like elements throughout unless otherwise noted.

FIG. 1 shows a perspective view of a known fuse 100, e.g., a cartridge fuse. End cap 130*a* is removed to make visible the assembled components. While reference is made to the exposed end of the fuse 100, it is understood that identical components are configured in the same manner at the other end, e.g., assembled within end cap 130*b*. Fuse body 105, which may be configured as a hollow fuse tube, has two ends 110*a*, 110*b* and a cavity 115. The fuse body 105 may be a hollow tube housing having a wall thickness and a circular cross-section, although other shapes are also envisioned. The fuse body 105 may be made out of an insulating material.

A fuse element 120 having terminal ends 120*a*, 120*b* (not shown), extend out of the ends 110*a*, 110*b* of the fuse body 105. The terminal ends 120*a*, 120*b* of the fuse element 120 are bent over the fuse body 105, for example, folded over an edge 135 of the hollow tube and being exposed on an outer surface of the fuse body 105. The fuse element 120 may be positioned diagonally in the fuse body 105, so that terminal ends 120*a*, 120*b* extend to opposite sides of the fuse body 105 at the respective ends 110*a*, 110*b*. In another embodiment, the fuse element 120 may be positioned in the center of the fuse body 105.

Plug 125 is disposed in the cavity 115 at each of the ends 110*a*, 110*b* to secure the fuse element 120 in place. The plug 125 may be flush with the end 110*a*, 110*b* of the fuse body 105 when it is inserted into the cavity 115, so that the plug 125 is not extending beyond an edge 135 of the fuse body 105. The plug 125 maintains a desired longitudinal tension with the fuse element 120 by pressing the terminal ends 120*a*, 120*b* against the housing wall of the fuse body 105. The plug 125 may be formed of elastic material, e.g., silicone, so that it secures against the inner surface of the fuse body 105 and the terminal end 120*a*, 120*b* of the fuse element 120 and holds the fuse element 120 in place. The plug 125 provides arc-quenching properties for the fuse 100, in that the plug 125 seals the fuse body 105 and quenches the arc before the arc reaches the end caps 130*a*, 130*b*, preventing a blow-out, or explosion, of the fuse, in an electrical overcurrent event.

End caps 130*a*, 130*b* are secured to the ends 110*a*, 110*b* of the fuse body 105. For example, end caps 130*a*, 130*b* may be secured via ridges 140 on the fuse body 105. The end caps 130*a*, 130*b* may be configured to enclose the fuse body 105, plug 125, and end of the fuse element 120*a*, 120*b* when coupled to the fuse body 105. Solder preform (not shown) may be disposed on the underside of the end cap, so that when the end caps 130*a*, 130*b* are assembled to the ends 120*a*, 120*b* of the fuse element 120, the solder preform is adjacent to ends 120*a*, 120*b* of the fuse element, the plug 125, and end 110*a*, 110*b* of the fuse body 105. During the assembly process, the fuse may become heated, allowing the solder to reflow and form a connection between the end caps 130*a*, 130*b* and fuse element 120. This results in an electrical path from end cap 130*a* to end cap 130*b*, or vice versa.

As described above, existing fuses where soldering occurs in a blind area presents several challenges. It can be difficult or costly to thoroughly inspect the solder connection without destructive testing. Undetected defects in the solder connection may result in decreased performance or reliability of the finished fuse.

Figure 2A:
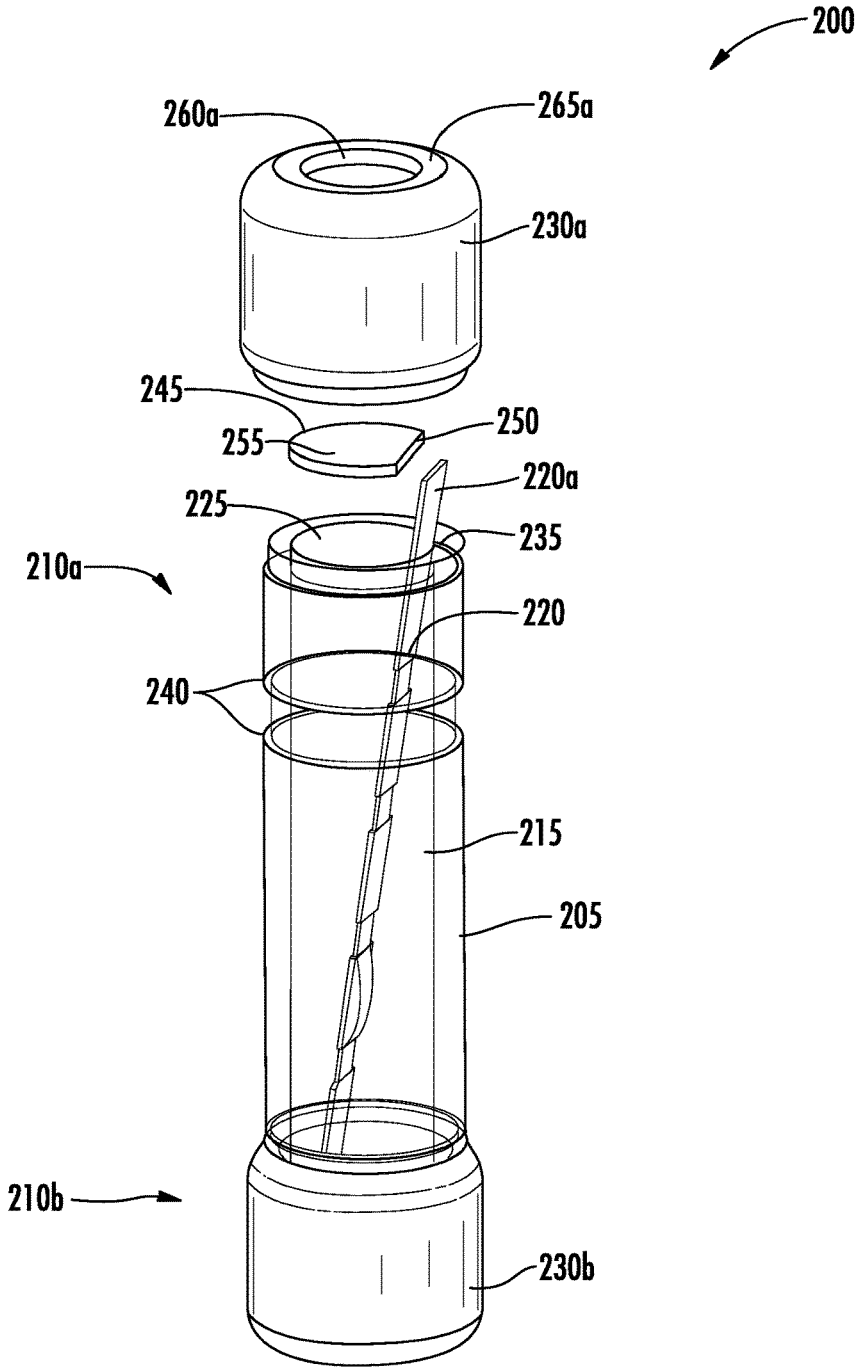
FIG. 2A is a partially exploded perspective view illustrating an example of a fuse according to embodiments of the present disclosure.

A fuse according to an embodiment of the present disclosure is depicted in FIGS. 2A-2E. FIG. 2A shows a perspective view of a fuse 200. End cap 230*a* is removed to make visible the assembled end components. While reference is made to the exposed end of the fuse 200, it is understood that identical components are configured in the same manner at the second end, e.g., assembled within end cap 230*b*.

Fuse element 220 having terminal ends 220*a* and 220*b* is disposed in the cavity 215, and the ends 220*a*, 220*b* extend beyond the fuse body 205. The fuse element 220 may be positioned diagonally in the fuse body 205, so that terminal ends 220*a*, 220*b* extend to opposite sides of the fuse body 205 at the respective ends 210*a*, 210*b* of the fuse body 205. In another embodiment, the fuse element 220 may be positioned in the center of the fuse body 205. The fuse element 220 is configured to create an open circuit in an overcurrent event. The fuse element 220 may be any known configuration for providing a circuit interrupt, including but not limited to a wire, a metal link, and an element shaped into multiple bends and/or curves.

The remaining open volume inside the cavity 215 may be filled with an arc-quenching material, such as silica sand. Plug 225 is disposed in the cavity 215 at each of the ends 210*a*, 210*b* to secure the fuse element 220 in place. The plug 225 may be flush with the end 210*a*, 210*b* of the fuse body 205 when it is inserted into the cavity 215, so that the plug 225 is not extending beyond edges 235 of the fuse body 205. For example, the arc disc 245 may be placed on the edge 235 of the fuse body 205. Edges 235 of the fuse body 205 may be the outermost ends of the hollow tube, at each end 210*a*, 210*b*. The plug 225 maintains a desired longitudinal tension with the fuse element 220 by pressing the ends 220*a*, 220*b* against the housing wall of the fuse body 205. The plug 225 may be formed of elastic material, e.g., silicone, so that it secures against the inner surface of the fuse body 205 and the end 220*a*, 220*b* of the fuse element 220 and holds the fuse element 220 in place. Alternatively, the plug 225 may be formed from any material with desired thermal and dielectric properties, e.g. glass fiber, plastic, rubber, etc. The plug 225 may also be formed from liquid products that are dispensed into the hollow fuse tube cavity 215 and cured in the final orientation, e.g. liquid silicone, epoxy, adhesive, etc. The plug 225 may be secured by compression of the plug within the fuse body 205 by securing against the inner surface of the fuse body 205. The elastic properties of the plug 225 allows the plug to seal the ends 210*a*, 210*b* of the fuse body 205, and hold the fuse element 220 in tension. In embodiments, the plug 225 may be secured within the fuse body 205 by adhesives, such as glue, etc.

Figure 2B:
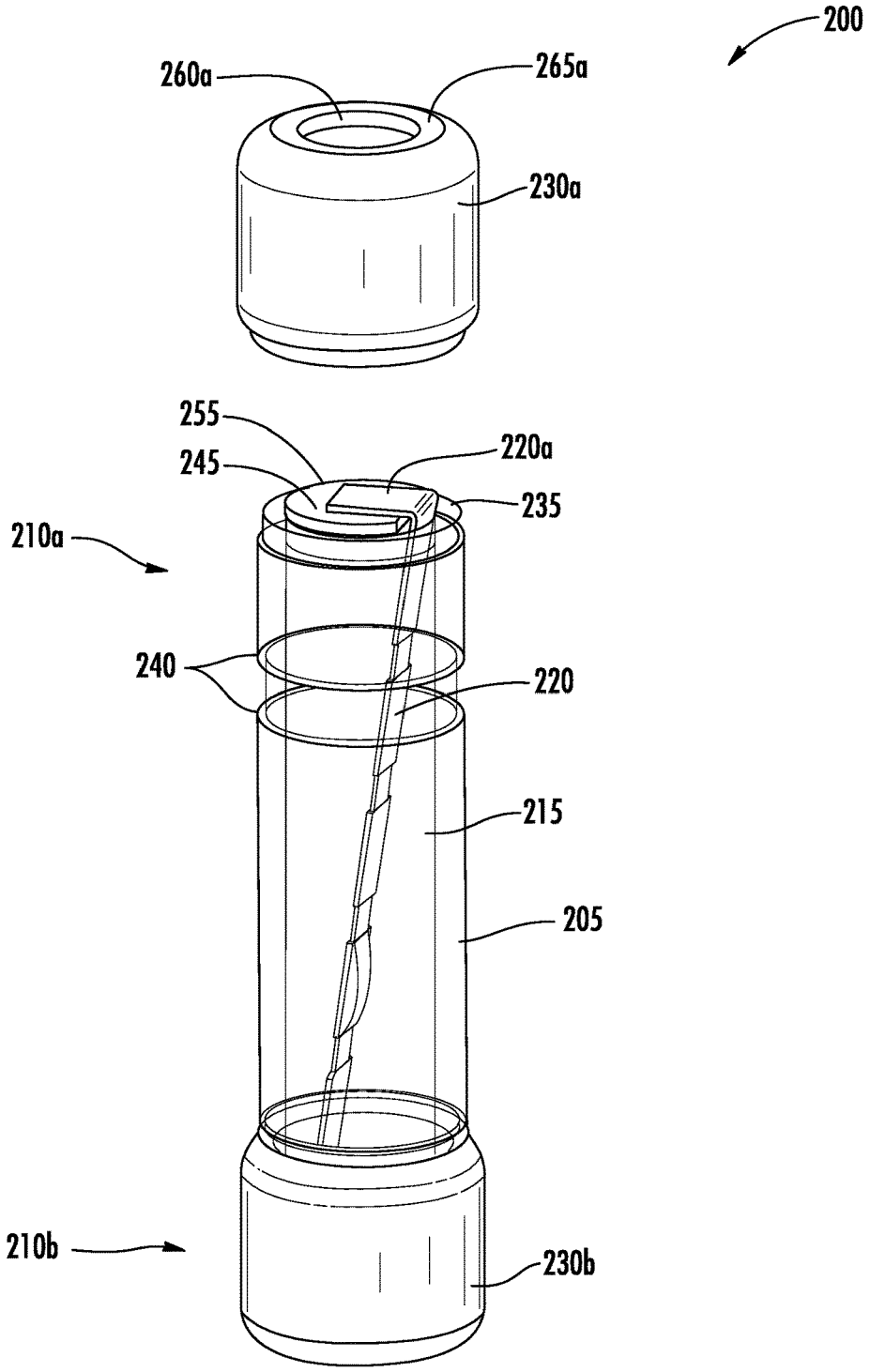
FIG. 2B is a partially exploded perspective view illustrating an example of a fuse according to embodiments of the present disclosure.

As shown in FIG. 2B, arc disc 245 is disposed on the ends 210*a*, 210*b* of the fuse body 205. The arc disc 245 may be disposed on the edge 235 of the fuse body 205, so that the arc disc 245 covers the plug 225. The arc disc 245 may be shaped like a circular disc, however, instead of being fully circular, a notch 250 may be cut away to provide a pass-through area for the end 220*a*, 220*b* of the fuse element 220. The notch 250 may be a straight cut to create a flat end of the arc disc 245, although any cut through allowing passage of the end 220*a*, 220*b*, such as a slot, chamfer, and scallop cut, is envisioned. The arc disc 245 may be made of a conducting material, e.g., a copper material, so that it may form an electrical connection with the fuse element 220.

Figure 2C:
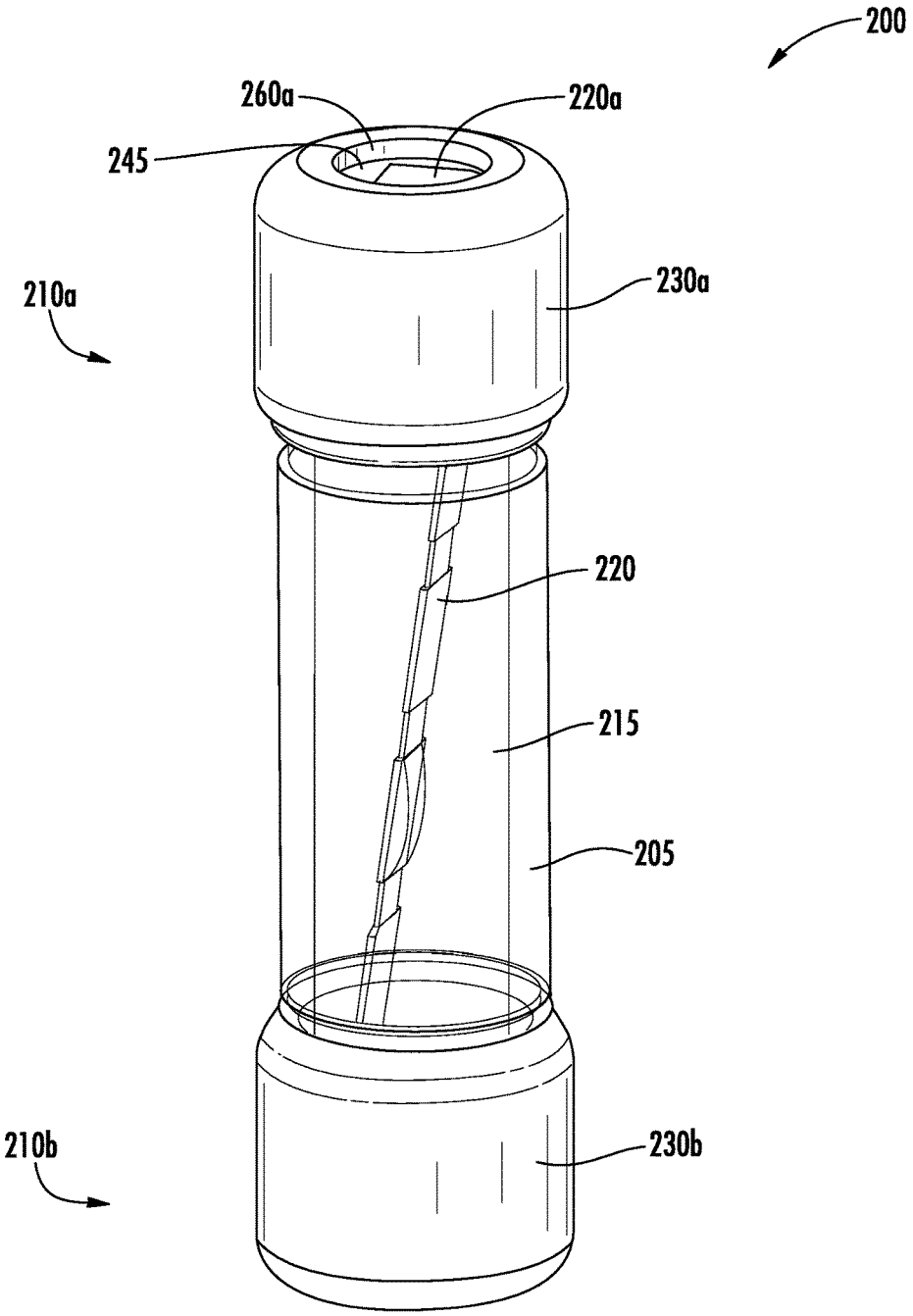
FIG. 2C is a perspective view illustrating an example of a fuse according to embodiments of the present disclosure, without solder installed.
Figure 2D:
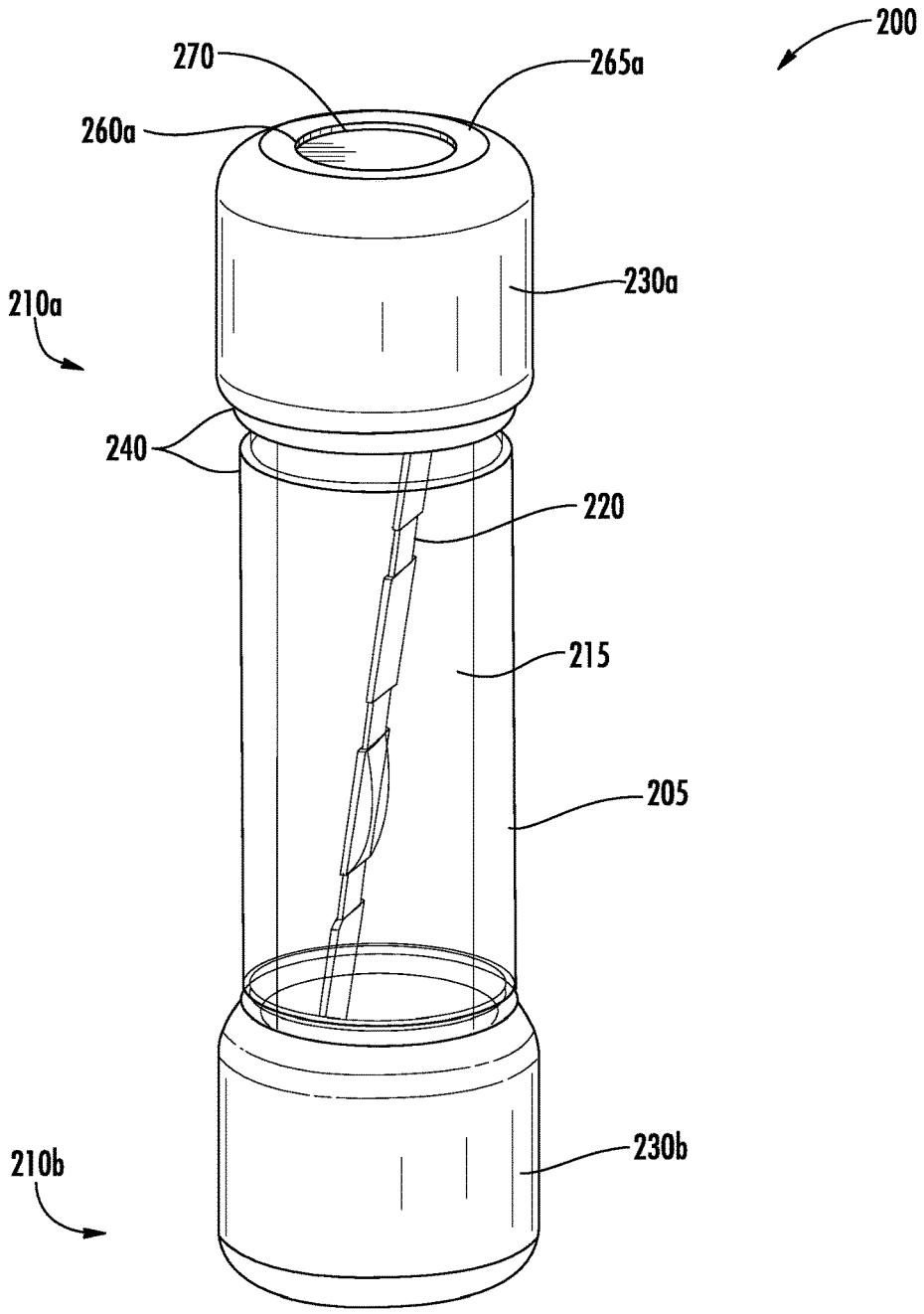
FIG. 2D is a perspective view illustrating an example of a fuse according to embodiments of the present disclosure, with solder installed.
Figure 2E:
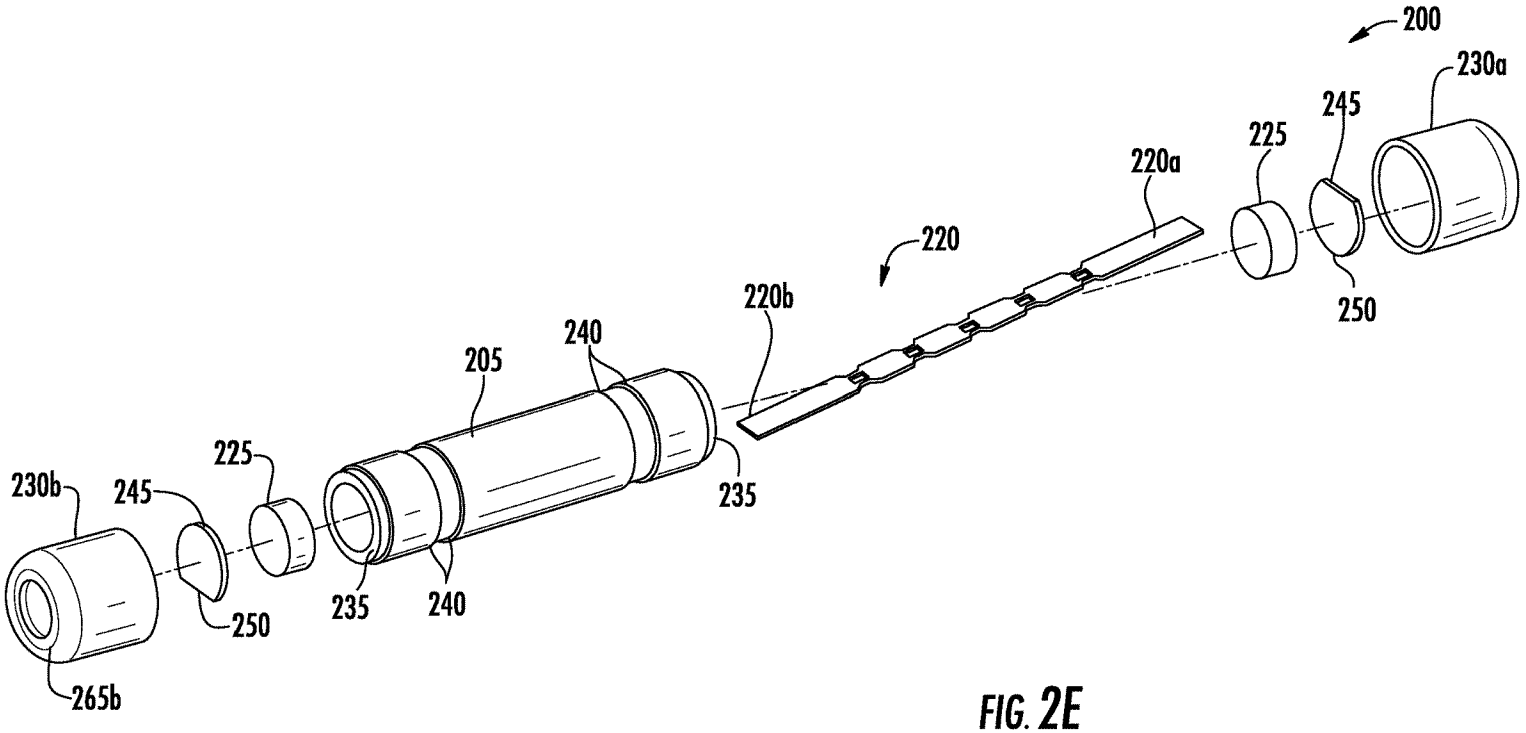
FIG. 2E is a fully exploded perspective view illustrating an example of a fuse according to embodiments of the present disclosure.

The fuse element 220 is shown in a straightened position in FIGS. 2A and 2E, so that ends 220*a*, 220*b* are not yet folded over. Referring again to FIG. 2B, terminal ends 220*a*, 220*b* may be folded across an outer surface 255 of the arc disc 245, the outer surface 255 being the surface facing away from the fuse body 205 and plug 225. The notch 250 in the arc disc 245 allows the end 220*a*, 220*b* of the fuse element 220 to bend over the arc disc 245. The end 220*a*, 220*b* is folded across the outer surface 255 of the arc disc 245 so that the end 220*a*, 220*b* may lay substantially flat. In an embodiment, the fold may be substantially 90°. The end 220*a*, 220*b* may substantially cover the outer surface 255 of the arc disc 245 when folded to ensure sufficient contact between the arc disc 245 and the fuse element 220. In embodiments, the fuse element 220 with the folded ends 220*a*, 220*b*, will create a "Z" shape, so that the fuse element 220 is disposed diagonally within the fuse body 205.

The arc disc 245 may act as an additional arc suppressant, and adds an additional layer of material for an arc to burn through before compromising the end caps 230*a*, 230*b* in a short circuit event. The arc disc 245 may also increase the strength of the end caps 230*a*, 230*b* by providing extra material to the underside of the end caps 230*a*, 230*b*. The mass of the arc disc 245 may also act as a heat sink, drawing heat away from the fuse element and allowing for cooler operating temperatures. As shown in FIGS. 2A-2E, end caps 230*a*, 230*b* include an aperture, or hole 260*a*, 260*b* on a top surface 265*a*, 265*b* of the respective end cap 230*a*, 230*b*. The hole 260*a*, 260*b* allows visual confirmation of placement of the end 220*a* of the fuse element 220 on the arc disc 245 disposed on the edge 235 of the fuse body 205, as shown in FIG. 2C. The hole 260*a*, 260*b* may be sized so that a user can visually see the end 220*a*, 220*b* of the fuse element 220 when the end caps 230*a*, 230*b* are assembled on the fuse 200. In embodiments, the hole 260*a*, 260*b* may be sized to have a diameter of any size up to the entire top surface 265*a*, 265*b* of the end cap 230*a*, 230*b*.

As shown in FIGS. 2C-2D, the end caps 230*a*, 230*b* are disposed on the ends 210*a*, 210*b* of the fuse body 205. The end caps 230*a*, 230*b* are attached to the fuse body 205 by covering the respective ends 210*a*, 210*b* of the fuse body 205, as well as the respective plugs 225, arc discs 245, and ends 220*a*, 220*b* of the fuse element 220. The end caps 230*a*, 230*b*, may be configured to allow any type of attachment to the fuse body 205, for example, press fit and/or mating grooves, as well as adhesives. In embodiments, the fuse body 205 may include ridges 240 to allow the end cap 230*a*, 230*b* to snap into place.

FIG. 2D illustrates a solder joint 270 filling the hole 260*a*, 260*b* of the end cap 230*a*, 230*b*. Solder may fill the hole 260*a*, 260*b* and any gaps around the fuse element 220 and arc disc 245 with an interior and/or underside surface of the end cap 230*a*, 230*b*. The solder joint 270 disposed within the hole 260*a*, 260*b* of the end cap 230*a*, 230*b* ensures that the fuse element 220 and arc disc 245 are electrically connected with end caps 230*a*, 230*b*, creating a continuous connection from end cap to end cap. As described above, the folded end 220*a*, 220*b* of the fuse element 220 across the outer surface 255 of the arc disc 245 provides a sure electrical connection when the solder joint 270 is applied. This is advantageous over existing fuses because the solder joint 270 can easily be inspected and pass through quality control checks prior to further processing, saving processing time, costs, and reducing quality defects in parts.

Figure 3:
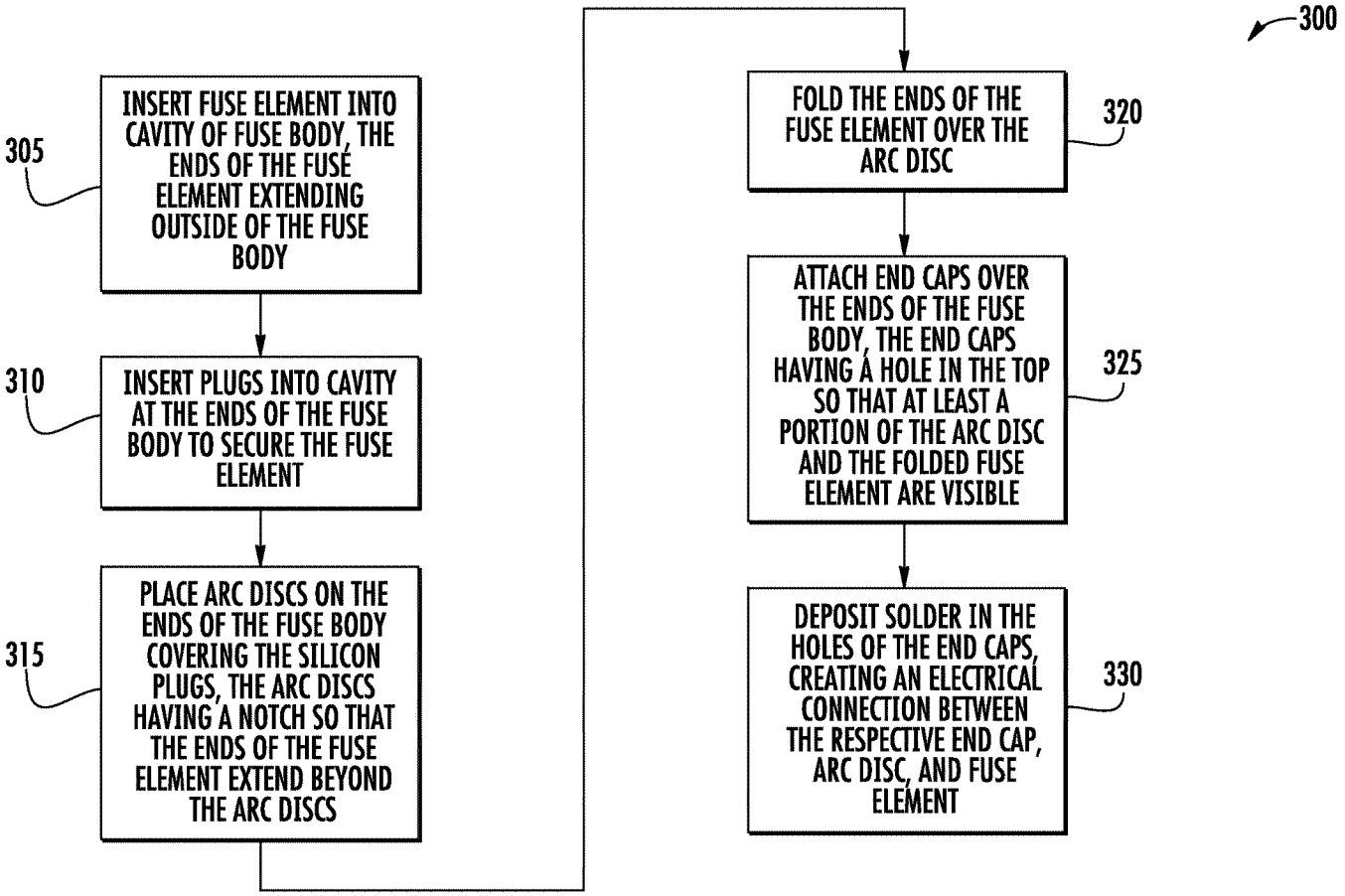
FIG. 3 is a flow diagram of a method of manufacturing a fuse according to the present disclosure.

FIG. 3 illustrates a flow diagram 300 of a method of manufacturing a fuse according to an embodiment of the present disclosure. At block 305, a fuse element may be inserted into a cavity of a fuse body, which may be a hollow tube having ends. The ends of the fuse element may extend beyond the ends of the fuse body. At block 310, plugs are inserted into each end of the fuse body. The plug is made out of an elastic material, e.g., rubber silicone, so that the plug may be compressed within the end of the fuse body and conforms against the inner surface of the fuse body. The ends of the fuse element extend out of the fuse body, and the plug presses against the fuse body and secures the fuse element against the fuse body. In embodiments, the fuse element is disposed diagonally in the fuse body, so that ends are secured against opposite sides of the fuse body.

At block 315, arc discs are placed over the plugs at each end of the fuse body. The arc disc may be placed on an edge at the end of the fuse body, so that the plug is covered. The arc disc includes a notch, which may be straight cut along one side to create a pass-through for the end of the fuse element. The notch may be any cut through in the arc disc to allow the end of the fuse element to extend beyond the fuse body.

At block 320, the ends of the fuse element are folded over across an outer surface of the arc discs. The outer surface is a side of the disc facing away from the fuse body. The end may be folded to lie flat on the arc disc. In embodiments, the bend may be substantially 90°. The ends may substantially cover the outer surface of the arc disc when folded. In embodiments, the fuse element with the folded ends will create a "Z" shape, so that the fuse element is disposed diagonally within the fuse body.

At block 325, the end caps are attached to the ends of the fuse body. The end caps have a hole positioned in the top surface so that the folded end of the fuse element and at least a portion of the arc disc are visible beneath the end cap. The end caps may be attached in any manner, including but not limited to adhesives, snap-on, press fit, and corresponding protrusions and grooves with the fuse body.

Solder is deposited in the hole at block 330, filling the hole and gaps between the arc disc, end of the fuse element and the end cap. The solder creates an electrical connection between the end cap the end of the fuse element, and the arc disc, so that there is a continuous electrical connection through the fuse between the end caps.

As used herein, references to "an embodiment," "an implementation," "an example," and/or equivalents is not intended to be interpreted as excluding the existence of additional embodiments also incorporating the recited features.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize its usefulness is not limited thereto and the present disclosure can be beneficially implemented in any number of environments for any number of purposes. Thus, the claims set forth below are to be construed in view of the full breadth and spirit of the present disclosure as described herein.

What is claimed is:

1. A fuse, comprising:

a fuse body having a first end and a second end, and defining a cavity;

a fuse element disposed within the cavity, a first end of the fuse element extending beyond a first edge of the first end of the fuse body;

a first arc disc formed as a flat disc and disposed directly on the first edge of the fuse body, the first arc disc including a notch cut providing a pass-through area for the first end of the fuse element extending beyond the first edge of the first end of the fuse body, wherein the first end of the fuse element is foldable over an outer surface of the first arc disc;

a first end cap disposed over the first end of the fuse body, the first arc disc, and the first end of the fuse element, the first end cap having a hole at a top surface and positioned to expose at least a portion of the first arc disc and the first end of the fuse element such that the first arc disc and the first end of the fuse element are visible under the first end cap; and a first plug disposed within the cavity at the first edge of the fuse body, wherein the first arc disc is directly disposed on the first plug to cover the first plug and the first edge of the fuse body;

wherein solder deposited within the hole covers the at least the portion of the first arc disc and the first end of the fuse element to provide an electrical connection between the first arc disc, the fuse element, and the first end cap.

2. The fuse of claim 1, further comprising:

a second end of the fuse element extending beyond a second edge of the second end of the fuse body;

a second arc disc formed as a flat disc and disposed directly on the second edge of the fuse body, the second arc disc including a notch cut providing a pass-through area for the second end of the fuse element extending beyond the second edge of the second end of the fuse body to an outer surface of the second arc disc, wherein the second end of the fuse element is foldable over the outer surface of the second arc disc; and a second end cap disposed over the second end of the fuse body, the second arc disc, and the second end of the fuse element, the second end cap having a hole at a top surface and positioned to expose at least a portion of the second arc disc and the second end of the fuse element, such that the second arc disc and the second end of the fuse element are visible under the second end cap;

wherein solder deposited within the hole covers the at least the portion of the second arc disc and the second end of the fuse element to provide an electrical connection between the second arc disc, the fuse element, and the second end cap.

3. The fuse of claim 2, further comprising a second plug disposed within the cavity at the second edge of the fuse body, wherein the second arc disc is directly disposed on the second plug to cover the first plug and the first edge of the fuse body, such that the first and second plugs seal the fuse element in the cavity of the fuse body.

4. The fuse of claim 2, wherein the outer surface of the first arc disc is coverable by the first end of the fuse element, and the outer surface of the second arc disc is coverable by the second end of the fuse element, to create contact between the fuse element and the first and second arc discs.

5. The fuse of claim 2, wherein the first and second arc discs are made of a copper material.

6. The fuse of claim 1, wherein the first end of the fuse element is folded at a substantially 90° angle such that the first end of the fuse element lays substantially flat across the outer surface of the first arc disc.

7. The fuse of claim 1, wherein the fuse body is made of an insulating material.

8. A fuse, comprising:

a hollow fuse tube;

a fuse element disposed within the hollow fuse tube, ends of the fuse element extending beyond edges of ends of the hollow fuse tube;

plugs disposed within the ends and at the edges of the hollow fuse tube, wherein the plugs secure the fuse element at each end within the hollow fuse tube;

arc discs directly disposed on the edges of the hollow fuse tube and covering the plugs, the arc discs having a notch cut providing a pass-through area for the ends of the fuse element extending beyond the edges of the hollow fuse tube, wherein the ends of the fuse element are foldable across an outer surface of the respective arc disc, and wherein the arc discs are directly disposed on the respective plugs to cover the plugs and the edges of the hollow fuse tube;

end caps covering the respective ends of the hollow fuse tube, plugs, arc discs, and folded ends of the fuse element, the end caps having a hole in a top surface to expose the arc disc and folded end of the fuse element such that the respective arc discs and the folded ends of the fuse element are visible under the end caps; and solder deposited within the hole of the end caps to cover the respective arc discs and the folded ends of the fuse element such that the respective end caps, arc discs, and folded ends of the fuse element are electrically connected.

9. The fuse of claim 8, wherein the ends of the fuse element are folded at a substantially 90° angle such that the ends of the fuse element lay substantially flat across the outer surface of the arc discs.

10. The fuse of claim 8, wherein the respective outer surface of the arc discs are coverable by the respective ends of the fuse element to create contact between the fuse element and the arc discs.

11. The fuse of claim 8, wherein the hollow fuse tube is made of an insulating material.

12. The fuse of claim 8, wherein the arc discs are made of a copper material.

13. A method for forming a fuse, comprising:

inserting a fuse element in a cavity of a fuse body, ends of the fuse element extending beyond edges of the respective ends of the fuse body;

assembling arc discs directly on the edges of the fuse body, the arc discs having a notch cut providing a pass-through area for the ends of the fuse element extending beyond the edges of the fuse body;

forming the ends of the fuse element over an outer surface of each arc disc;

attaching end caps over the respective ends of the fuse body and the arc discs, the end caps having a hole at a top surface of the end cap, the hole being positioned to expose at least a portion of the respective arc disc and the formed ends of the fuse element when attached such that the respective arc discs and the formed ends of the fuse element are visible under the end caps;

inserting plugs within the cavity at the respective edges of the fuse body, wherein the respective arc discs are directly disposed on the respective plugs to cover plugs and the edges of the fuse body;

depositing solder in the hole of the end cap to cover the at least the portion of the respective arc discs and the formed ends of the fuse element, such that the end cap, the arc disc, and the formed end of the fuse element at each end of the fuse body are electrically connected.

14. The method of claim 13, wherein the ends of the fuse element are foldable at a substantially 90° angle such that the ends of the fuse element lay flat across the respective outer surface of the arc disc.

15. The method of claim 13, wherein the respective outer surface of the arc discs are coverable by the respective ends of the fuse element to create contact between the fuse element and the arc discs.

16. The method of claim 13, wherein the fuse body is made of an insulating material.

17. The method of claim 13, wherein the arc discs are made of a copper material.

18. The fuse of claim 6, wherein the second end of the fuse element is folded at a substantially 90° angle such that the second end of the fuse element lays substantially flat across the outer surface of the second arc disc, such that the folded first and second ends form a Z-shape of the fuse element to extend at an angle within the fuse body.

* * * * *